US006033609A

United States Patent [19]

Wright et al.

[11] Patent Number: 6,033,609

[45] Date of Patent: Mar. 7, 2000

[54] DEVICE AND METHOD TO PREVENT SPINNERET HOLE CONTAMINATION

[75] Inventors: Donald E. Wright; Albert R. Moorhead, both of Anderson, S.C.

[73] Assignee: BASF Corporation, Mt. Olive, N.J.

[21] Appl. No.: 08/959,522

[22] Filed: Oct. 28, 1997

[51] Int. Cl.[7] ..... D01D 1/10; D01D 4/02; D01D 5/08

[52] U.S. Cl. ..... 264/169; 210/446; 264/176.1; 425/198; 425/199; 425/461

[58] Field of Search ..... 264/169, 176.1; 425/198, 199, 461; 210/446

[56] References Cited

U.S. PATENT DOCUMENTS

| | | | |
|---|---|---|---|
| 2,792,122 | 5/1957 | Münch et al. . | |
| 2,990,576 | 7/1961 | Van Riper . | |
| 3,570,059 | 3/1971 | Mott . | |
| 3,802,821 | 4/1974 | Mott . | |
| 3,847,524 | 11/1974 | Mott . | |
| 3,888,963 | 6/1975 | Orso et al. . | |
| 3,938,925 | 2/1976 | Lees . | |
| 4,077,880 | 3/1978 | Lorenz et al. | 425/199 X |
| 4,257,901 | 3/1981 | Rapp . | |
| 4,358,375 | 11/1982 | Wood . | |
| 4,406,850 | 9/1983 | Hills . | |
| 4,493,628 | 1/1985 | Lenk . | |
| 4,875,846 | 10/1989 | Reinbold . | |
| 5,449,459 | 9/1995 | Glaser et al. . | |

OTHER PUBLICATIONS

Industry News; Stork Veco B.V.; New! VECOPORE spin pack screens; IFJ/Aug. 1996 (1 page).

Stork; Working on your application; Stork Veco B.V.; Stork Veco International; David M. Haines, Vice President/Marketing and Business Development (8 pages) (Aug. 30, 1996).

Stork Veco International; Precision Perforated Products; Bassett Communications Company, Traverse City, Michigan (9 pages) (Undated).

*Primary Examiner*—Leo B. Tentoni
*Attorney, Agent, or Firm*—Laura D. Nammo

[57] ABSTRACT

A spin pot for spinning synthetic polymer fibers has a polymer filter, a spinneret downstream of the polymer filter, and an electroformed perforated screen positioned between the polymer filter and the spinneret. The screen is most preferably electroformed nickel and includes an annular non-perforated region which bounds a perforated central region. The electroformed perforations prevent debris that may become dislodged from the filter unit from blocking the spinneret orifices thereby creating undesired "slow-holes".

11 Claims, 3 Drawing Sheets

DEVICE AND METHOD TO PREVENT SPINNERET HOLE CONTAMINATION

FIELD OF THE INVENTION

The present invention is generally related to the field of synthetic fiber production. In preferred embodiments, the present invention is related to devices and methods by which synthetic filaments are produced, and particularly to spinnerets employed in such production.

BACKGROUND AND SUMMARY OF THE INVENTION

Synthetic filaments are traditionally produced by various spinning techniques. For example, synthetic filaments may be melt-spun by extruding a melt spinnable polymer through relatively small-sized orifices in a spin pack to form a stream of filaments. The filaments are substantially immediately solidified by passing a cross-flow of solidification fluid (e.g., air) through a quench cabinet. The filaments are thereafter continuously taken up by a high speed winder to form a generally cylindrical package.

Conventional spin packs may include a number of spin pots, each of which in turn includes a polymer filter (e.g., screen packs), a polymer distribution plate and a spinneret plate in that order. The polymer filter, distribution plate and spinneret plate are held in a housing pot that may be removed from the spin pack to allow servicing and/or replacement of the individual structural components of the spin pot.

Oftentimes, the flow through spinneret holes become blocked due to contamination that is present in the system downstream of the filter. In this regard, the polymer filters are typically formed of a sintered metal (i.e., so-called Mott filters in accordance with U.S. Pat. Nos. 3,570,059 and 3,802,821, the entire content of each being expressly incorporated hereinto by reference). Thus, particles of such sintered metal from the Mott filters and/or other debris that may remain from the filter cleaning operation can be dislodged and carried downstream with the polymer flow where they block one or more spinneret holes. These blocked spinneret holes are known colloquially in the art as "slow-holes" since the polymer flow therethrough is impeded. When slow-holes occur, the entire spinning line must be shut down in order to prevent the production of off-specification product.

It would therefore be desirable if the occurrence of such slow-holes could be minimized or eliminated entirely. It is towards providing such a solution that the present invention is directed.

Broadly, the present invention is embodied in synthetic filament spin pots and methods of spinning synthetic filaments which employ an electroformed perforated screen downstream of the polymer filter. In this regard, the perforated screen serves to remove debris from the polymer screen that may exist downstream of the polymer filter unit (e.g., debris that may be dislodged from the filter unit, or parts of the filter unit itself) so as to significantly minimize the occurrence of "slow-holes" in the spinning line.

Other aspects and advantages of the present invention will become more clear from the following detailed description of the preferred exemplary embodiments thereof which follow.

BRIEF DESCRIPTION OF THE ACCOMPANYING DRAWINGS

DETAILED DESCRIPTION OF THE INVENTION

Figure 1:
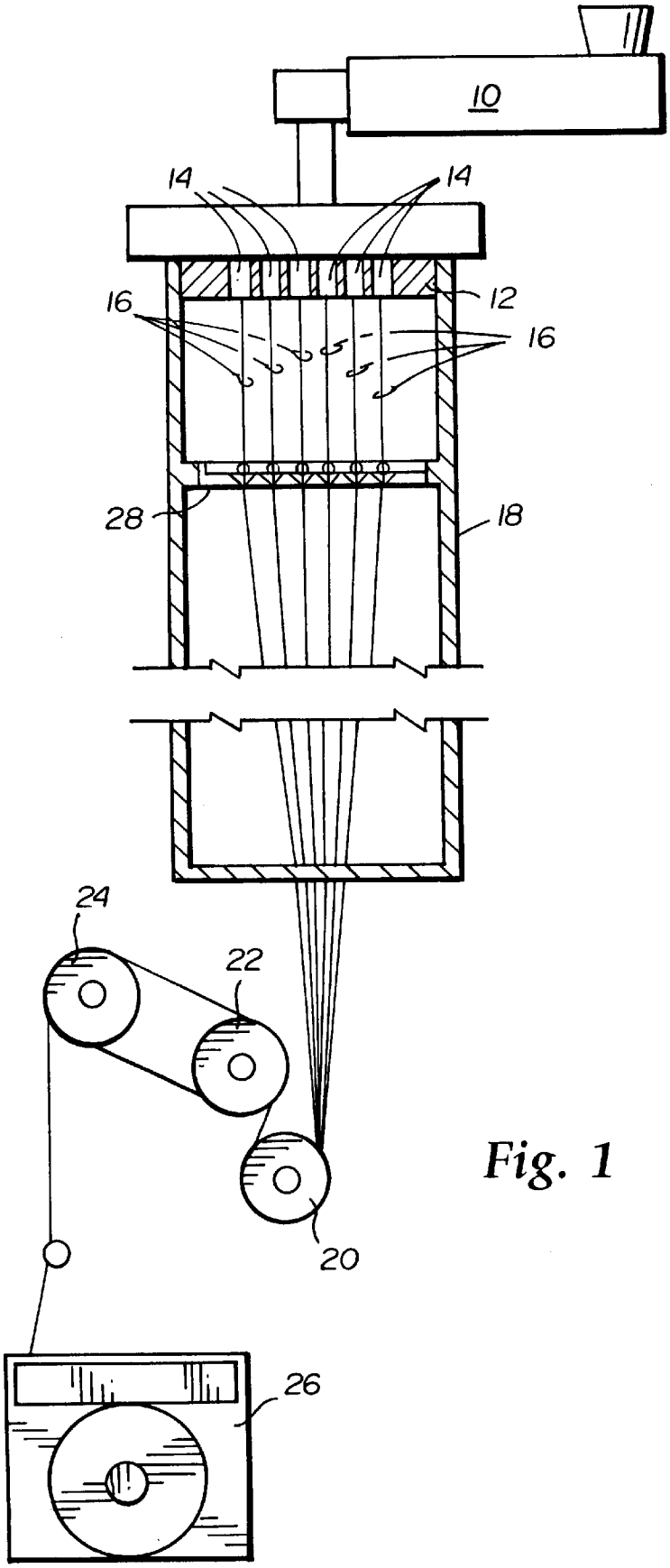
FIG. 1 is a schematic illustration of a melt-spinning system in which the modified spin pots of this invention may be employed.

In a typical melt-spinning system as depicted in FIG. 1, an extruder 10 extrudes a polymer melt through a spin pack 12 having a plurality of spin pots 14 therein. The spin pots 14 include a plurality of spinneret orifices that, in turn, form a plurality of filament threadlines 16. It will be understood that, depending on the intended end use, each of the threadlines may include a single filament or may include any number of filaments. Preferably, however, each threadline 16 is formed of a plurality of individual filaments. The filament threadlines 16 are cooled in a quench cabinet 18 (e.g., by a flow of quench air or other quench fluid) and are converged at take-up roll 20 to form a yarn. The filaments of the yarn may thereafter be drawn by Godet rolls 22, 24 and taken up by a winder 26. Prior to being taken up by the winder 26, the filament threadlines may be brought into contact with a finish applicator 28 so that finish oil may be applied thereto.

Figure 2:
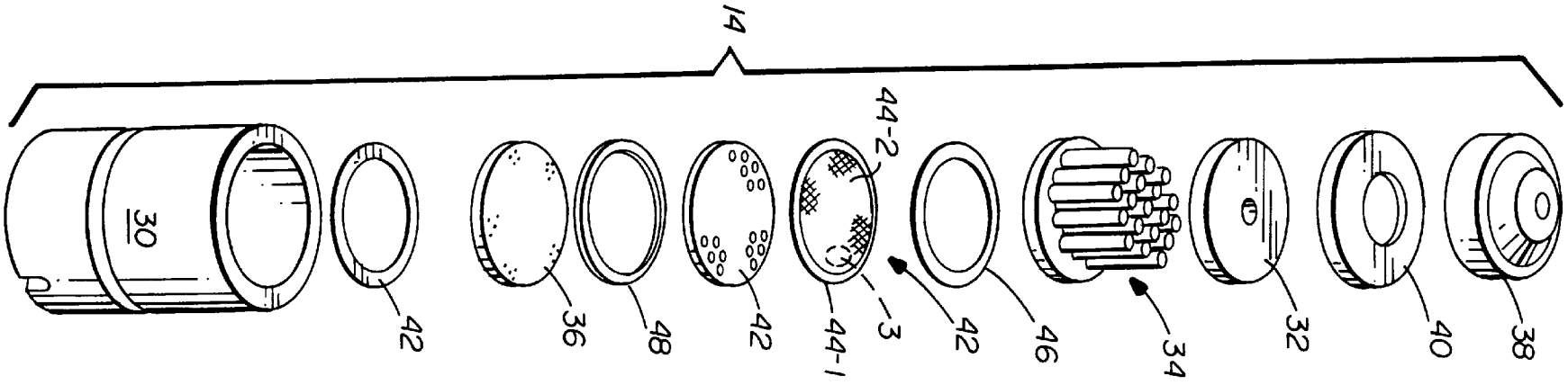
FIG. 2 is an exploded perspective view of an exemplary spin pot in accordance with the present invention.

The principal structures employed in an exemplary spin pot 14 according to the present invention is depicted in accompanying FIG. 2. In this regard, the spin pot 14 includes a generally cylindrical housing 30 which houses an apertured polymer distribution plate 32, a Mott filter unit 34 and a spinneret plate 36 in that order. The housing 30 is sealed at its upper end via an end cap 38 and a membrane gasket 40 interposed between the cap 38 and the distribution plate 32. At its lower end, the housing 30 is sealed against polymer leakage by a gasket 42 interposed between the spinneret 36 and the housing 30.

Important to the present invention, a rigid apertured support plate 50 is provided so as to support a relatively thin, flexible perforated electroformed screen 44. Specifically, the support plate 50 is provided as a mechanical support for the screen 44 and includes a high density of apertures sufficient in size and number so as to maintain the support plate's rigidity. The screen 44 unitarily includes a peripheral annular nonperforated region 44-1 which bounds a central perforated region 44-2. The support plate 50 and screen are sealed between the upstream Mott filter unit 34 and the downstream spinneret 36 by means of annular gaskets 46, 48, respectively.

Figure 3:
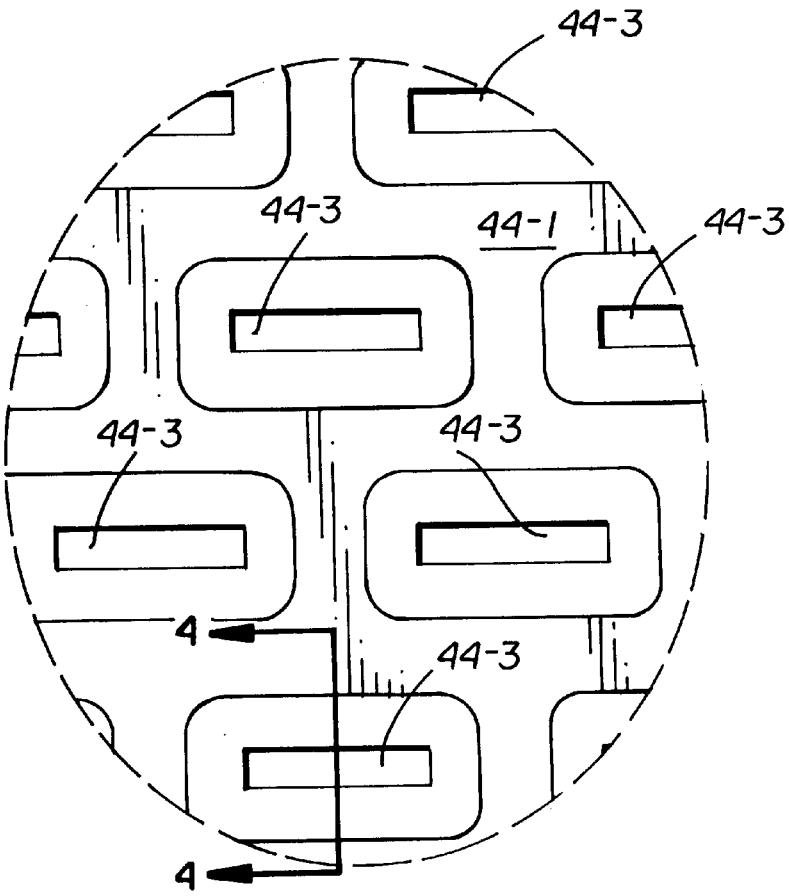
FIG. 3 is an enlarged bottom plan view of the upstream side of an exemplary electroformed screen that is employed in the spin pot depicted in FIG. 2.

The perforation pattern of the central region 44-2 is shown in a greatly enlarged (approximately 200X) manner in accompanying FIG. 3. As shown therein, the individual perforations 44-3 are generally rectangularly shaped and are oriented in a row and column matrix such that perforations 44-3 in adjacent rows are offset from one another. The width-wise (narrower) dimension of each perforation establishes the smallest nominally sized particle that is prevented from passing therethrough. In this regard, when thermoplastic polymers (e.g., nylons such as nylon 6, nylon 6,6 and the like) are spun, the widthwise dimension of the perforations 44-3 should be between about $25\mu$ to about $44\mu$, and most preferably between about $32\mu$ to about $40\mu$. Particularly favorable results have been obtained when utilized for spinning nylon 6 thermoplastic polymer by perforations

44-3 having a widthwise dimension of about 38$\mu$. The lengthwise dimension and the spacings between the perforations 44-3 are chosen so as to minimize the pressure drop of the polymer flow through the screen 44 while maintaining its mechanical integrity at the operating pressures involved. Thus, as a general rule, the lengthwise dimension of the perforations 44-3 should be as long as possible, and the spacing between adjacent perforations should be as small as possible within the design considerations noted previously. Again, using nylon 6 polymer as an example, the lengthwise dimension of the perforations can be up to between about 150 to about 155$\mu$ or less with the spacings between the perforations (both end-to-end and laterally) being within the range of about 110$\mu$ to about 150$\mu$, and more typically between about 120$\mu$ and about 135$\mu$. The thickness of the screen 44 may range from between about 0.001 inch to about 0.005 inch.

Figure 4:
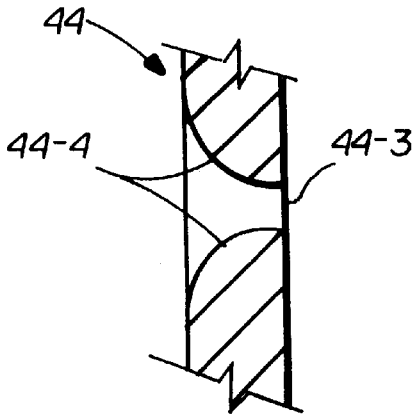
FIG. 4 is a cross-section elevational view of an exemplary perforation in the screen of FIG. 3 as taken along line 4—4 therein.

The perforated screen 44 is most preferably formed of an electroformed metal such as nickel, copper, silver or gold. Most preferably, however, the screen 44 is formed of electroformed nickel. As shown in FIG. 4, the electroforming process creates a gently sloped shoulder region 44-4 which terminates in the well defined rectangular shape of the perforation 44-3. The shoulder region 44-4 is thus most preferably positioned in an downstream direction—i.e., adjacent the apertured support plate 50—with the well defined rectangularly shaped perforation 44-3 being positioned in an upstream direction—i.e., adjacent the Mott filter unit 34.

The electroplated perforated screen may be obtained commercially, for example, from Stork Veco International of Bedford, Mass. In this regard, in the electroforming process, a photographic film is used to produce the precise perforation pattern on a metal matrix. The matrix, which is used as the cathode, is submerged in an electroplating bath. With the application of an electrical current, the metal in the electroplating solution (e.g., nickel) is attracted to the pattern on the matrix, for the part.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A spin pot for spinning synthetic polymer fibers comprising a polymer filter, a spinneret downstream of said polymer filter, and an electroformed perforated screen positioned between said polymer filter and said spinnerets wherein said screen include, an annular, non-perforated region which bounds a central perforated region.

2. The spin pot as in claim 1, wherein the perforations have a rectangular geometry.

3. The spin pot as in claim 2, wherein the perforations have a widthwise dimension of between about 25 to about 44$\mu$.

4. The spin pot as in claim 2, wherein the perforations have a widthwise dimension of between about 32 to about 40$\mu$.

5. The spin pot as in claim 2, wherein the perforations have a widthwise dimension of about 38$\mu$.

6. The spin pot as in claim 2, wherein the rectangular perforations are arranged in a column and row matrix.

7. The spin pot as in claim 6, wherein the perforations in one row of the matrix are offset from the perforations of an adjacent row in the matrix.

8. The spin pot as in claim 1, wherein the screen is electroformed from nickel, copper, silver or gold.

9. The spin pot as in claim 1, wherein the screen unitarily includes an annular non-perforated region which bounds a perforated central region.

10. The spin pot as in claim 1, wherein the perforations include a convexly shaped upstream shoulder region.

11. In a method of spinning synthetic fibers by forcing a fiber forming polymer through a polymer filter unit and then through spinneret orifices, the improvement comprising interposing an electroformed perforated screen, wherein said screen includes an annular non-perforated region which bounds a central perforated region, between said polymer filter unit and said spinneret orifices and trapping debris in the polymer flow therein to prevent clogging of said spinneret orifices.

* * * * *

UNITED STATES PATENT AND TRADEMARK OFFICE

CERTIFICATE OF CORRECTION

PATENT NO : 6,033,609

DATED : March 7, 2000

INVENTOR(S) : Donald E. Wright, Albert R. Moorhead

It is certified that error appears in the above-identified patent and that said Letters Patent is hereby corrected as shown below:

At column 4, line 41, please insert --during formation of said synthetic fibers-- after "orifices" and before the period (".").

Signed and Sealed this

Sixth Day of March, 2001

*Attest:*

NICHOLAS P. GODICI

*Attesting Officer*

*Acting Director of the United States Patent and Trademark Office*